United States Patent [19]

Bauer et al.

[11] 4,297,837

[45] Nov. 3, 1981

[54] METHOD AND APPARATUS FOR PRODUCING SPUN YARN CHARACTERISTICS IN SYNTHETIC MULTIFILAMENT YARNS

[75] Inventors: Karl Bauer, Remscheid; Eberhard Krenzer, Ennepetal-Rüggeberg, both of Fed. Rep. of Germany

[73] Assignee: Barmag Barmer Maschinenfabrik Aktiengesellschaft, Remscheid, Fed. Rep. of Germany

[21] Appl. No.: 100,357

[22] Filed: Dec. 5, 1979

[30] Foreign Application Priority Data

Dec. 18, 1978 [DE] Fed. Rep. of Germany ..... 2854578

[51] Int. Cl.[3] ..... D02J 3/02; D02G 1/16

[52] U.S. Cl. ..... 57/350; 57/309; 57/337; 57/339

[58] Field of Search ..... 57/2, 3, 6, 200, 247, 57/206, 207, 282, 284, 289, 309, 350, 339, 334

[56] References Cited

U.S. PATENT DOCUMENTS

| | | | |
|---|---|---|---|
| 3,001,358 | 9/1961 | Mayner | 57/2 X |
| 3,158,983 | 12/1964 | Tlamicha | 57/309 X |
| 3,645,080 | 2/1972 | Yamagata | 57/2 |
| 3,685,273 | 8/1972 | Neveux | 57/334 X |
| 3,831,360 | 8/1974 | Horvath | 57/2 |
| 3,857,233 | 12/1974 | Cardinal et al. | 57/289 X |
| 3,946,548 | 3/1976 | Hino et al. | 57/247 |
| 3,973,383 | 8/1976 | Yu | 57/339 |
| 4,095,403 | 6/1978 | Beraud et al. | 57/2 X |
| 4,164,836 | 8/1979 | Tanae et al. | 57/339 X |

FOREIGN PATENT DOCUMENTS

| | | |
|---|---|---|
| 2749867 | 10/1979 | Fed. Rep. of Germany . |
| 1418768 | 10/1965 | France . |
| 1501109 | 2/1978 | United Kingdom . |
| 2013746 | 8/1979 | United Kingdom . |

*Primary Examiner*—Donald Watkins

*Attorney, Agent, or Firm*—Bell, Seltzer, Park & Gibson

[57] ABSTRACT

A method and apparatus is provided for producing a synthetic multifilament yarn having appearance, bulk and hand characteristics of conventional spun yarns of staple fibers while retaining strength characteristics of continuous filament yarns. The multifilament yarn is air jet textured to form loops, bows, coils and the like in at least the surface filaments thereof and at least some of these loops, bows, coils and the like only in the surface filaments are parted while the interior or core filaments remain substantially intact to form a yarn having free filament or fiber ends projecting from a substantially continuous filament core. The interior or core filaments are shielded or protected from being parted by false twisting the yarn (without heat setting the twist therein) to provide a substantially closed form with the interior or core filaments surrounded by the surface filaments and by parting the surface filaments while the yarn has twist therein. Also, other steps are taken and means are provided for limiting the filament parting action solely to the surface filaments. Finally, the yarn is heat set after the filaments are parted and after the twist is removed to fix the characteristics imparted in the previous processing steps therein.

36 Claims, 14 Drawing Figures

Fig.4
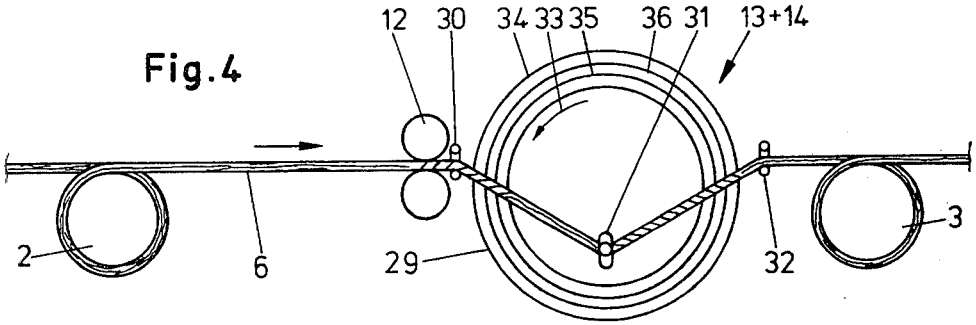
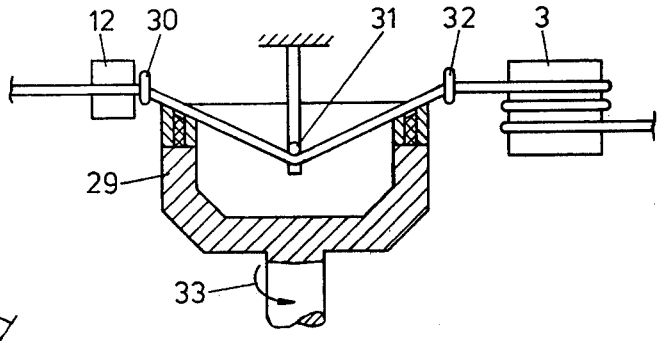
Fig.5
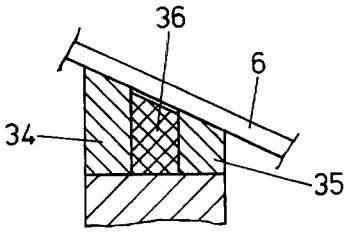
Fig.5a
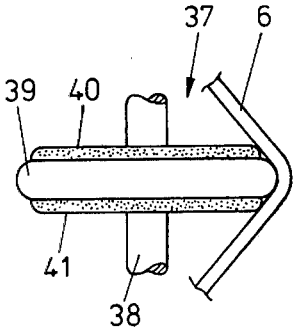
Fig.9
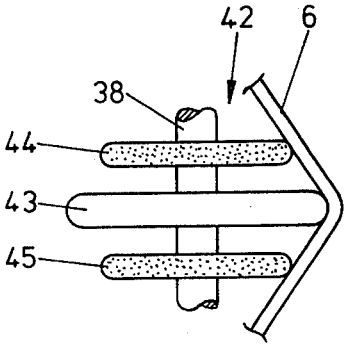
Fig.10

METHOD AND APPARATUS FOR PRODUCING SPUN YARN CHARACTERISTICS IN SYNTHETIC MULTIFILAMENT YARNS

FIELD OF THE INVENTION

The present invention relates to the production of synthetic multifilament yarns having certain appearance, bulk and hand characteristics usually obtained only with spun staple fiber yarns. More particularly, the present invention relates to a method of and apparatus for producing a synthetic multifilament yarn having the appearance, bulk and hand of conventional spun yarns while retaining strength characteristics of continuous filament yarns.

BACKGROUND OF THE INVENTION

In the production of yarns for various and sundry textile fabrics and other uses, much attention has been given to finding a method by which certain desirable characteristics of conventional spun yarns, e.g. appearance, bulk and hand, could be imparted to synthetic multifilament yarns. It has previously been proposed, e.g. U.S. Pat. No. 3,946,548, to produce synthetic multifilament yarns having such characteristics by over-feeding the multifilament yarn through a high velocity air jet texturing device whereby the filaments of the yarn are entangled and have loops, bows, coils and the like formed therein. The action of an air jet texturing device on such yarns is well known to persons skilled in the texturing art. The yarn after passing through the air jet texturing device is false twist textured by twisting, heat setting the twist (and the loops, bows, coils and the like formed by the air jet texturing) in the yarn and then untwisting in well-known manner.

In this previously proposed process, the textured yarn is contacted by a friction element, either before the yarn reaches or after it has left the false twist texturing zone, which parts at least some of the filaments of the yarn to produce free filament ends projecting from the yarn. While providing the desired yarn characteristics of appearance, bulk and hand, this process has presented substantial disadvantages. Foremost among these disadvantages is the fact that the strength characteristics of the yarn are materially degraded. This degradation of the strength of the yarn is due to the fact that the friction element may contact and part any of the filaments of the yarn including those filaments which would normally be considered as interior or core filaments. Therefore, the structural integrity of the yarn, normally obtained with continuous filaments, is destroyed and the yarn strength is considerably impaired.

SUMMARY OF THE INVENTION

With the foregoing in mind, it is an object of the present invention to provide a method of and apparatus for producing synthetic multifilament yarns having the appearance, bulk and hand of conventional spun yarns which overcome the above mentioned deficiencies and disadvantages of previously proposed methods and apparatus. In accordance with the method and apparatus of the present invention, such deficiencies and disadvantages are overcome by imparting the appearance, bulk and hand characteristics to the yarn in such a manner that only the surface filaments of the yarn are parted to form the projecting free filament ends while the interior filaments of the yarn are maintained substantially intact.

It is another object of the present invention to provide a method of and apparatus for producing synthetic multifilament yarn having the appearance, bulk and hand of conventional spun yarns while retaining strength characteristics of continuous filament yarns. This object of the present invention is accomplished by air jet texturing the synthetic multifilament yarn to form loops, bows, coils and the like in the filaments thereof, false twisting the air jet textured yarn, parting only the surface filaments of the yarn while maintaining the interior filaments substantially intact by subjecting the yarn, while in its closed or twisted state, to the parting action of a cutter, friction surface or the like, removing the false twist from the yarn, and then heat setting the yarn to fix the remaining texturing effects in the yarn.

BRIEF DESCRIPTION OF THE DRAWINGS

FIG. 4 is a schematic fragmentary view of another embodiment of false twist device and filament parting device of the present invention;

FIG. 5 is a schematic view, partially in section, of the false twist and filament parting devices shown in FIG. 4;

FIG. 5A is an enlarged fragmentary sectional view of a portion of the device shown in FIG. 5;

FIG. 9 is a fragmentary view of false twist and filament parting disc which may be used with the devices shown in FIGS. 6 and 7;

FIG. 10 is a fragmentary view similar to FIG. 9 of a slightly modified version of false twist and filament parting discs;

DETAILED DESCRIPTION OF THE INVENTION

Figure 1:
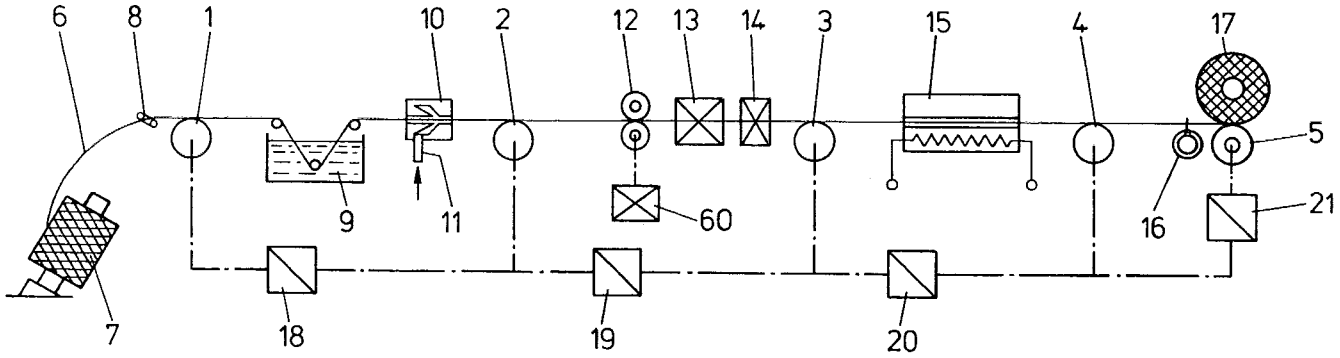
FIG. 1 is a schematic view illustrating the method and apparatus of the present invention.

Referring now more particularly to the drawings and specifically to FIG. 1, the apparatus of the present invention is there illustrated as comprising five sets of yarn feeding means 1, 2, 3, 4 and 5 which are respectively driven at different speeds by suitable drive means 18, 19, 20 and 21. These yarn feeding means and drive means therefor may be of any suitable conventional form and such are well known to persons skilled in the applicable textile arts.

Specifically, yarn feeding means 1 withdraws yarn 6 from a yarn package 7 supported in a suitable creel through a yarn guide 8 and delivers the yarn into an air jet texturing zone. The yarn feed means 1 defines the upstream end of the air texturing zone and the yarn feed means 2 defines the downstream end thereof. Preferably, yarn feed means 1 and 2 are driven by their respective drive means in such a manner that a substantial overfeed of the yarn 6 occurs within the air texturing zone. For example, such yarn overfeed may amount to as much as 300% if desired.

Located within the air jet texturing zone is a yarn bath 9 with guide means for guiding the yarn 6 into and out of the bath whereby the yarn 6 is suitably moistened. An air jet texturing device 10 which has high velocity air supplied thereto through suitable supply means 11 is also located in the air texturing zone between yarn bath 9 and feed means 2. The structure of the air jet texturing device 10 is well known to those skilled in the yarn texturing art and need not be specifically described herein. Several embodiments of suitable air texturing devices, as well as the appearance of yarn textured thereby, are illustrated in U.S. Pat. Nos. 2,852,906; 2,869,967; 2,982,000; 2,994,938; 3,017,737; 3,545,057; 3,577,614; 3,835,510; and others. During its passage through the air jet texturing device 10, the synthetic multifilament yarn 6 has the filaments thereof entangled by the action of the high velocity air and the individual filaments have loops, bows, coils and the like formed therein.

In accordance with the present invention, it is distinctly preferred that the yarn 6 leaving the air texturing zone has a significant number of filaments which substantially retain their in-line or straight condition and, thus, determine the strength and elongation properties of the finished yarn. On the other hand, it is essential to the successful practice of the method of this invention that a significant number of other filaments of the yarn leaving the air texturing zone be deflected from an in-line or straight condition and have loops, bows, coils and the like formed therein. The development of these yarn characteristics is influenced to a substantial degree by the technological parameters of the texturing zone, but may also be influenced by the filamentary characteristics of the yarns being processed. Accordingly, it is specifically contemplated by this invention that yarns having differing filamentary characteristics chosen to influence the development of the aforementioned yarn characteristics be utilized in practicing the method of the present invention. For example, yarns may be utilized which have filaments of the same polymeric material but of different deniers selected to provide the strength and elongation characteristics on one hand and the formation of the loops, bows, coils and the like on the other hand. Also, yarns may be utilized which have blended filaments of different polymeric materials (such as polyester and polyamides) selected for the same reasons, or any combination of filaments of different polymeric materials and different deniers may be used to control yarn characteristics in accordance with this invention.

The air jet textured yarn is delivered from the air texturing zone by the yarn feed system 2 into a yarn stabilizing zone. The upstream end of the yarn stabilizing zone is defined by the yarn feed means 2 and the downstream end thereof is defined by the yarn feed means 3. Preferably, yarn feed means 3 has a yarn feeding speed greater than yarn feed means 2 so that the textured yarn 6 is placed under tension in the yarn stabilizing zone.

Located within the yarn stabilizing zone between yarn feed means 2 and 3 is a twist stop device 12 comprising two rolls defining a yarn gripping nip therebetween. Yarn twist stop means 12 may be idling rolls or may be connected to a suitable brake system 60 whereby a different and higher tension is applied to the yarn 6 between twist stop means 12 and the yarn feed means 3 than exists between the twist stop means 12 and the yarn feed means 2. Also, if desired, twist stop means 12 may be connected to a suitable drive system (not shown) whereby the rolls 12 may be independently driven to apply a higher tension to the yarn 6 in the area between the twist stop means 12 and yarn feed means 2 than is provided between twist stop means 12 and yarn feed means 3.

A surface filament parting means 13 is positioned between twist stop means 12 and yarn feed means 3 and serves to part the surface filaments of the yarn 6 while maintaining the interior or core filaments substantially intact. A false twist means 14 is positioned between filament parting means 13 and yarn feed means 3 for imparting twist to the yarn 6 between the false twist means 14 and the twist stop means 12. Accordingly, the yarn 6 has twist therein when the same passes through the filament parting means 13. As is well known with false twist devices, the twist imparted thereto in a dynamic continuous operation extends upstream of the direction of movement of the yarn from the false twist device while no twist extends downstream of the false twist device. Therefore, the yarn 6 will have twist therein in the area between twist stop means 12 and false twist means 14 but will have no twist therein between false twist means 14 and yarn feed means 5.

A suitable heating means 15 is located between yarn feed means 3 and 4 for increasing the temperature of the filaments of the yarn to that point required to heat set the yarn and fix in the yarn 6 any remaining textured effects imparted thereto in the air texturing zone. As is well known, such heat setting of the yarn also results in the yarn being shrunk. It is further particularly noted that, unlike prior devices, the apparatus of the present invention does not heat set the yarn in the stabilizing zone nor while any false twist remains therein.

Once the yarn leaves yarn feed means 4, the same passes to yarn feed means 5 which cooperates with a suitable traverse motion 16 to wind the yarn into a package 17. Preferably, the circumferential speed of yarn feed means or drive roll 5 is variable so that the yarn 6 may be wound into package 17 under a tension which is suitable for further treatment or processing and one which enables a troublefree unwinding of the yarn from the package 17.

False twist means 14 may be of any suitable construction and many forms of such false twist devices are well known to persons skilled in the yarn texturing art. Nevertheless, several different forms of false twist devices are illustrated and will be described hereinafter.

Figure 2:
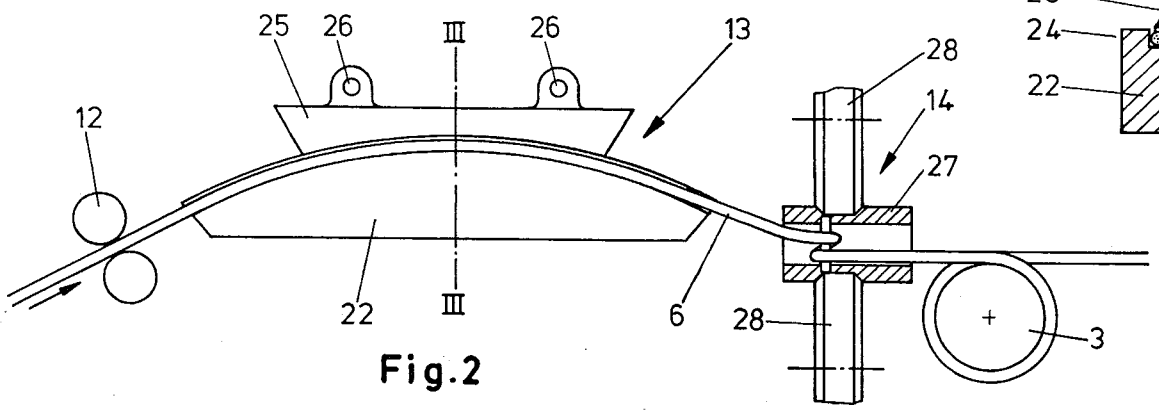
FIG. 2 is a fragmentary view, partially in section, illustrating one embodiment of a false twist device and filament parting device of the present invention.

As illustrated in FIG. 2, false twist means 14 comprises a spindle 27 having a pin which is adapted to have the yarn 6 wrapped or snubbed therearound. Spindle 27 is suitable driven in rotation by drive discs 28 which, in turn, are driven from a suitable motive source (not shown).

Figure 3:
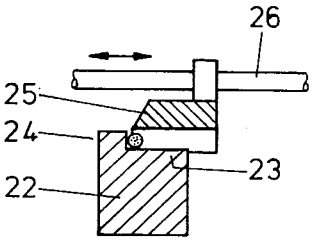
FIG. 3 is a fragmentary view, partially in section, taken substantially along the line 3—3 in FIG. 2.

Filament parting means 13 may also be of any suitable construction and several suitable constructions are illustrated and will be described hereinafter with particular reference to particular figures of the drawings. In FIGS. 2 and 3, filament parting means 13 is illustrated as comprising a reciprocating cutting device cooperating with a stationary surface to part the filaments by a scissors or shearing action. Specifically, filament parting means 13 comprises a blade 25 carried by a reciprocating rod 26. A yarn guide means 22 is provided for guiding the yarn 6 past the reciprocating blade 25 while limiting contact of the blade 25 to only the surface filaments while maintaining the interior or core filaments substantially intact. Yarn guide means 22 has a curved guide surface 23 and a raised guide edge 24 which extends beyond the guide surface 23 a sufficient distance so that only the projecting loops, bows, coils and the like from the surface filaments are presented to the cutting blade 25. Blade 25 cooperates with the yarn guide edge 24 in a scissorslike manner.

The reciprocating movement of the blade 25 is coordinated with the speed of movement of the yarn 6 so that each portion of yarn 6 is subjected to the filament cutting or parting action of the blade 25. In this respect, it is noted that the twist imparted to the yarn 6 by the false twist means 14 will cause the yarn to rotate about its longitudinal axis as it passes over the guide surface 23 so that all portions of the outer periphery of the yarn are subjected to the cutting action of blade 25.

Figure 11:
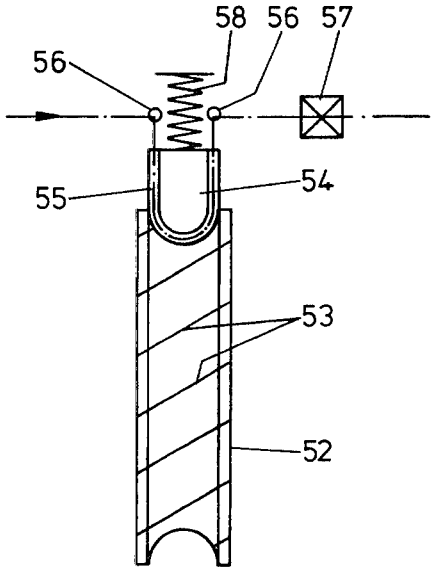
FIG. 11 is a schematic fragmentary view of a modified form of filament parting device.
Figure 12:
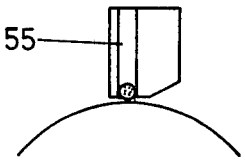
FIG. 12 is a fragmentary side elevational view of the filament parting device shown in FIG. 11.

A rotating cutting member 52 (FIGS. 11 and 12) may be substituted for the reciprocating blade 25 and yarn guide means 54 may be substituted for yarn guide means 22. The rotating cutting member 52 comprises a wheel or disc having a relatively large number of cutting blades 53 positioned about is periphery. Yarn guide means 54 has a guide groove 55 formed in the outer surface thereof the depth of which is approximately the same as the diameter of yarn 6 so that only the projecting loops, coils and the like from the surface filaments will be presented to the cutting blades 53. Also, the guide means 54 preferably has a considerable curvature sufficient to provide a 180° yarn looping angle in the path of travel of the yarn past the cutting member 52 to ensure that the yarn is not pulled out of the groove 55 by the cutting blades 53.

A pair of threaded guides 56 are provided adjacent opposite sides of guide means 54 for guiding the yarn into and away from the groove 55. Preferably, the guide means 54 is pressed against the rotating cutting member 52 by a suitable compression spring 58 so that the blades 53 cooperate with the edges of the groove 55 to provide a shearing action.

With the rotating cutting member 52, the cutting frequency and yarn speed may be substantially increased over the reciprocating blade 25 illustrated in FIGS. 2 and 3. Therefore, considerably increased production may be achieved with such a rotating cutting member.

Referring now to FIGS. 4 through 5A, there is illustrated another embodiment of the filament parting means 13 and false twist means 14. As there illustrated, a cup-shaped member 29 having an outer rim defining a yarn engaging surface is provided and is suitably driven in a manner not shown in the direction of the arrow 33. Suitable thread guides 30, 31 and 32 are associated with the cup-shaped member 29 to guide the yarn 6 into and out of contact with the yarn engaging surface thereof.

The outer rim of cup-shaped member 29 is defined by two friction members 34 and 35 disposed on opposite sides of another friction member 36. Friction members 34 and 35 have outer yarn engaging surfaces which are relatively smooth and having only sufficient roughness to provide desired false twist effect without abrading or parting any of the filaments of the yarn brought into contact therewith. Therefore, friction members 34, 35 may be referred to as false twist imparting members and preferably have a surface roughness of less than 4 μm. On the other hand, friction body 36 has an outer surface with a roughness, preferably more than 4 μm, which is of sufficient character as to engage and rupture or part the projecting loops, bows, coils and the like in the surface filaments of the yarn. As used herein, "roughness" relates to the average roughness value "Ra" as defined in Dubbels Manual for Machine Engineering, Twelfth Edition, at pages 595 and 596, with reference to respective standards (arithmetic average of the distances of the actual profile from the average profile).

While friction member 36 (and other forms of friction type filament parting means disclosed herein) may be formed of any suitable material, an advantageously usable friction surface therefor is provided by very hard particles, such as sapphire or diamond particles, embedded in a binding agent, such as suitable wear resistant metals, e.g. nickel or certain alloys. It is preferred that such hard particles be mammilated.

The outer surfaces of the false twist imparting members 34 and 35 very accurately define a path of travel of the yarn 6 past the filament parting member 36. To ensure that only the surface filaments of the yarn are contacted and parted, friction member 36 is mounted so that the outer surface thereof is recessed from the outer surfaces of friction members 34, 35 and from the path of travel of the yarn.

The portions of the false twist imparting members 34 and 35 which contact the yarn adjacent yarn guide 30 will impart a false twist to the yarn in one direction which will extend upstream relative to the direction of travel of the yarn until such twist is stopped by the twist limiting means 12. On the other hand, the portions of the false twist imparting members 34 and 35 contacting the yarn adjacent yarn guide 32 will impart false twist to the yarn in an opposite direction which will extend upstream with respect to the direction of travel of the yarn to the threaded guide 31 which will serve a twist limiting effect. By this arrangement, it is ensured that the yarn 6 will be in twisted form when the surface filaments thereof are parted by the filament parting member 36.

Figure 6:
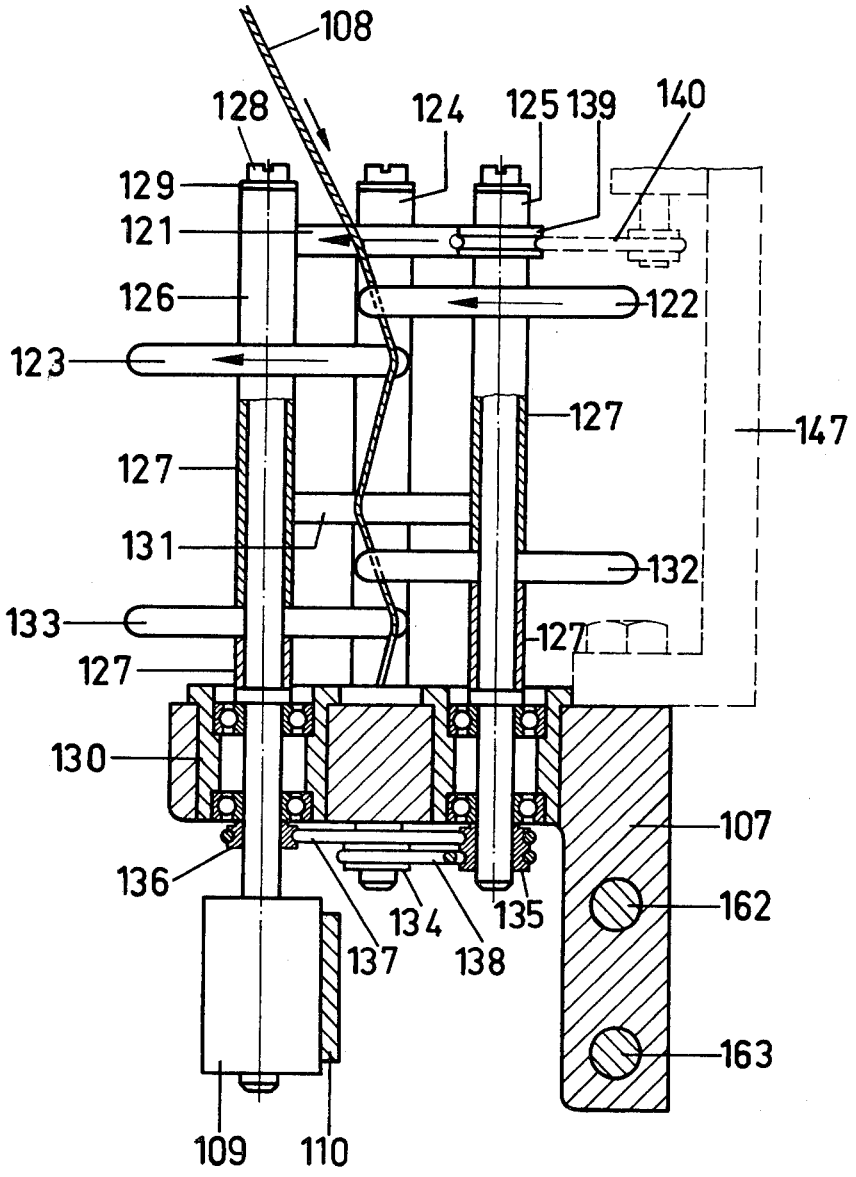
FIG. 6 is a fragmentary view, partially in section, of a further embodiment of false twist and filament parting devices of the present invention.

Referring now to FIG. 6, there is illustrated therein another embodiment of false twist means 14 which is a friction disc assembly substantially as shown and described in U.S. Pat. No. 3,813,868, issued June 4, 1974, and assigned to the same assignee as this application. This friction disc assembly comprises three shafts 124, 125 and 126 which are rotatably mounted by sleeves 130 in a frame 107. Frame 107 is mounted on shafts 162 and 163 for suitable positioning along the path of travel of the yarn 6 from the feed means 2 to the feed means 3. Shaft 126 includes a drive whorl 109 on one end thereof which contacts a drive belt 110. Shaft 125 is driven from shaft 126 and shaft 124 is driven from shaft 125 by means of drive belts 137 and 138 and belt pulleys 134, 135 and 136.

The three shafts 124, 125 and 126 drivingly mount friction discs 121, 122 and 123 adjacent the free ends thereof opposite the frame 107 and friction discs 131, 132 and 133 adjacent the ends thereof mounted in the frame 107. The friction discs 121, 122, 123 and 131, 132, 133 are arranged on the shafts 124, 125 and 126, and the shafts are arranged relative to each other, such that the yarn (referred to in this figure by reference character 108) is guided through the friction disc assembly along a particular path of travel. The friction discs are spaced along their respective shafts by sleeves 127 and the discs and sleeves are held in assembled relation by nuts 128 and washers 129 at the free ends of the shafts 124, 125 and 126. The spacing between the shafts and the diameters of the discs 121, 122, 123, 131, 132 and 133 are such that if projected on a plane, the discs overlap each other and form a triangle with the yarn 108 being tensioned and guided over the outside edges during its path of travel through the twist assembly in a spiral which has a triangular cross-section.

In accordance with this invention, the discs 121, 122, 123 and 131, 132 and 133 are provided with surfaces particularly selected to accomplish solely the false twist imparting purposes or selected so that these discs perform both the false twist and filament parting functions of the present method and apparatus. In the former arrangement, all of the discs would be provided with substantially the same surface characteristics which would be selected so as to impart twist to the yarn without abrading or parting any of the filaments thereof. In this arrangement, a separate filament parting means would be employed upstream of the friction disc assembly or between that assembly and the twist limiting means 12.

In the combined function friction disc assembly, the discs 131, 132 and 133 could be provided with surfaces which are particularly selected and suitable for imparting false twist to the yarn whereas discs 121, 122 and 123 could be provided with surface characteristics suitable for parting or rupturing the surface filaments of the yarn. In this arrangement, the surface characteristics of the filament parting discs 121, 122, 123 would be considerably rougher than those of the false twist imparting discs 131, 132, 133 and would preferably be greater than 4 $\mu$m. Alternatively, only the first disc 121 at the entry end of the friction disc assembly may be provided with suitable filament parting surface characteristics for parting the surface filaments of the yarn. This arrangement has the advantage that the yarn can be so guided and controlled that it does not touch the rough surface of the filament parting disc 121 with any of the interior or core filaments and only the surface filaments contact the friction surface and are parted thereby.

This friction disc assembly is particularly advantageous since the path of travel of the yarn through the assembly may be very accurately defined and controlled even though the yarn is being guided over moving surfaces. Still further, the friction effect, looping angle and yarn tension may also be very finely adjusted and controlled to precisely control the actions performed on the yarn by the friction discs and to only rupture or part a predetermined amount of the loops, bows, coils and the like of the surface filaments while the interior or core filaments remain substantially unaffected.

Figure 7:
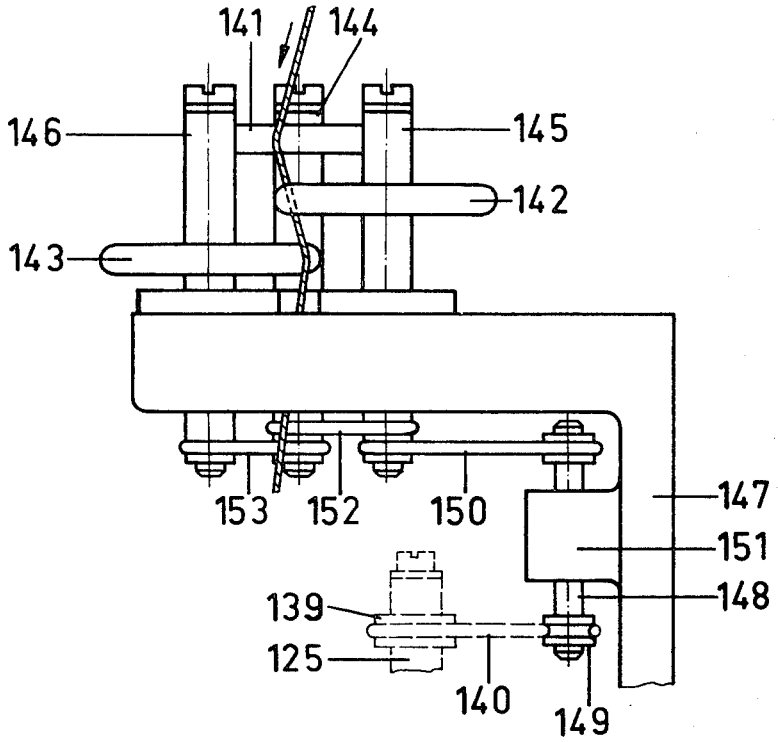
FIG. 7 is a view of a false twist attachment which may be used with the device shown in FIG. 6.
Figure 8:
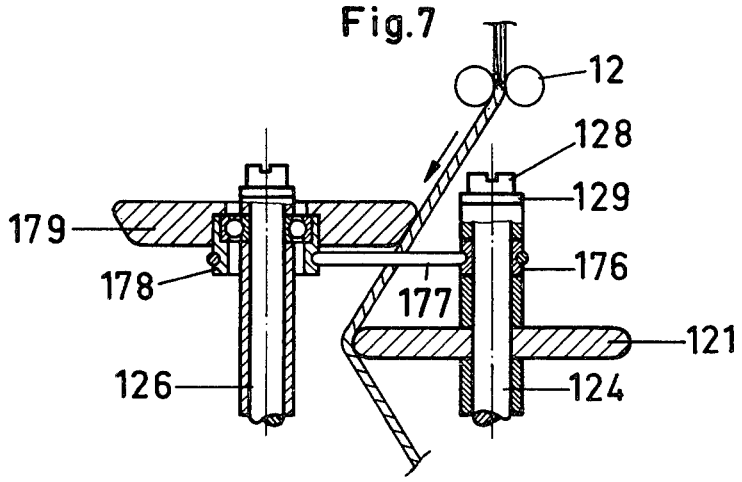
FIG. 8 is a fragmentary sectional view illustrating a filament parting device which may be used with the device shown in FIG. 6.

In the form of friction disc assembly illustrated in FIG. 6 and hereinabove described, all of the discs are driven at the same speed. Referring now to FIGS. 7 and 8, there is illustrated a friction disc assembly similar to that illustrated in FIG. 6 in which the friction discs may be driven at different circumferential speeds, either higher or lower as the case may be.

The friction disc assembly as illustrated in FIG. 7 may be attached to the frame 107 by a connecting member 147 which supports a drive shaft 148 journaled in a suitable boss 151 on the connecting member 147. The shaft 148 is suitably drivingly connected to shaft 125 of the arrangement illustrated in FIG. 6 by a belt and pulley arrangement 139, 140 and 149 and, in turn, shaft 148 is connected to three shafts 144, 145 and 146 by belts 150, 152 and 153. Shafts 144, 145 and 146 are journaled for rotation in the connecting member 147 and have mounted thereon friction discs 141, 142 and 143. Due to the transmission which may be provided between shaft 125 and shafts 148 and 145, discs 141, 142 and 143 may be driven at a different, preferably higher, circumferential speed than the discs 121, 122, 123 and 131, 132 and 133 of the friction disc assembly illustrated in FIG. 6.

Further, it is also possible, at the yarn entry, to use friction discs 121, 122, 123 in FIG. 6 or 141, 142, 143 in FIG. 7, of such a diameter and at such axial spacing so that the discs overlap less or not at all. In a borderline case, these discs could even form, as viewed in top plan, a narrow and straight eyelet for the passage of the interior or core filaments of the yarn.

When the friction disc assembly, as illustrated in FIG. 6, has all of the discs thereof functioning as twist imparting discs, then separate filament parting means must be provided, and such a separate filament parting means is illustrated in FIG. 8. As there shown, a filament parting friction disc 179 is rotatably mounted on the free end of shaft 126 by suitable bearings. Filament parting disc 179 has a drive pulley 178 connected thereto and a belt 177 connects pulley 178 to a pulley 176 mounted on shaft 124. By this arrangement, the friction disc 179 is driven independently of the shaft 126. By selecting a desired transmission ratio between the belt pulleys 176 and 178, the circumferential speed of filament parting disc 179 may be varied from those of the other discs of the twist assembly as illustrated in FIG. 6. Preferably, filament parting disc 179 is shaped like a frustum so that its yarn engaging peripheral surface is parallel to the path of travel of the yarn for a significant portion of that path of travel. Also, the yarn engaging surface of filament parting disc 179 is tangent to the surface of the yarn over as large a portion of the yarn as possible. In accordance with this invention, the friction disc 179 is so positioned with respect to the path of travel of the yarn that its rough surface engages only the projecting loops, bows, coils of the surface filaments while the interior or core filaments remain substantially unaffected thereby.

Also, the direction of rotation of the filament parting disc 179 may be in the same direction as the direction of rotation of the discs 121, 122, 123 or may be in the reverse direction by suitably changing the drive arrangement 176, 177 and 178. In this manner, the effects obtained on the yarn may be very precisely selected and controlled.

The present invention specifically contemplates that a friction disc assembly of the type illustrated in FIGS. 6, 7 or 8 could be provided with combination friction discs which would provide both false twist and filament parting functions. A first embodiment of such a combination disc is illustrated in FIG. 9 in which the disc 37 is shown as mounted on a shaft 38 and comprising a center, twist imparting layer 39 and outer filament parting layers 40 and 41 positioned on opposite sides of the center layer 39. In this arrangement, center layer 39 has a relatively smooth outer surface so as not to abrade or rupture any of the filaments of the yarn while layers 40 and 41 have a roughened surface for parting the surface filaments. In addition, the diameter of layers 40 and 41 is less than the diameter of the center layer 39 and is selected so that only the projecting loops, bows, coils and the like of the surface filaments will contact the roughened surface of layers 40 and 41 and be parted thereby.

Referring now to FIG. 10, there is illustrated a different embodiment of a combination false twist imparting and filament parting disc assembly 42 in which a false twist disc 43 is mounted on shaft 38 between two spaced apart filament parting discs 44 and 45. The surface of the disc 43 is comparable to that of the center layer 39 in the form illustrated in FIG. 9 and the surfaces of discs 44 and 45 are similar to that of layers 40 and 41 in that same form.

Obviously, in both forms illustrated in FIGS. 9 and 10, only one of the filament parting outer layers 40, 41 or discs 44, 45 could be employed without departing from the spirit and scope of this invention. Also, the combination disc assembly illustrated in either FIG. 9 or 10 may be substituted for any one or all of the discs, except for the last disc 133, in any of the arrangements illustrated in FIGS. 6, 7 or 8.

Figure 13:
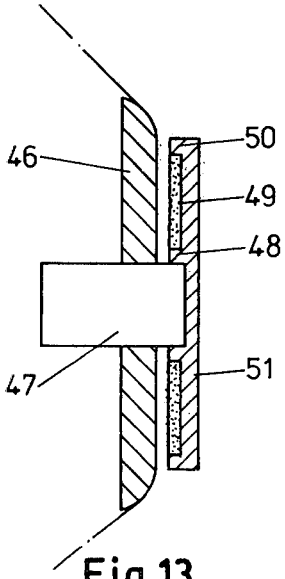
FIG. 13 is a fragmentary sectional view illustrating another modified form of false twist and filament parting devices.

Referring now to FIG. 13, there is illustrated another arrangement for imparting false twist to the yarn while parting the loops, bows, coils and the like in the surface filaments. As there illustrated a rotatably driven shaft 47 mounts both a false twist imparting disc 46 and a filament parting disc 51 for rotation. False twist imparting disc 46 preferably has a smooth surface about which the yarn is guided, which surface may be entirely curved. In any event, the yarn engaging surface of the disc 46 is curved at its outer periphery to an extent so that the yarn will be conducted over the surface of the disc with a certain amount of looping or in a path of travel defining an obtuse included angle. Consequently, the yarn will rest firmly against the surface of the disc from one outer periphery thereof to the other.

The filament parting disc 51 is spaced from the false twist imparting disc 46 a sufficient distance so that the friction layer 49 thereon will contact only the surface filaments and projecting loops, bows, coils and the like thereof while leaving the interior or core filaments substantially untouched. The friction layer 49 of filament parting disc 51 has the surface properties previously described to provide for filament parting.

Preferably, filament parting disc 51 includes guide rings or flanges 48 and 50 concentrically positioned around the inside and outside peripheries of the friction layer 49 and which function to ensure that the yarn does not migrate into intensive contact with the friction layer 49. Consequently, the interior or core filaments are not parted thereby.

As will be apparent, various embodiments of false twist and filament parting means embodying the features of the present invention have been described. In all of the illustrated embodiments, particularly of the friction type false twist and filament parting means, the friction surfaces have a component thereof moving transversely of the path of travel of the yarn. In operation of these friction surfaces, the speed ratios are preferably selected so that the ratio between friction surface speed D and yarn speed Y is preferably greater than 3, but in any event is greater than 2. Thus, sufficient false twist is imparted to adequately bind the interior or core filaments together, while sufficient relative speed between the filament parting surface and the yarn is provided to part or rupture the loops, bows, coils and the like in the surface filaments. Such parting of these surface filaments is an impact stress rather than a tension and breaking of the filaments. Consequently, the length of the free projecting filament ends is kept relatively short and the loops, bows, coils and the like are not materially lengthened by being pulled from the yarn during parting thereof. Both the amount of the loops, bows, coils and the like which are parted and the length of the free projecting filament ends are affected by the speed ratio between the friction surfaces and travel of the yarn.

Also, in all of the illustrated embodiments of filament parting means, the yarn is guided past the filament parting means through a predetermined looping angle. This looping angle assists in ensuring that the interior or core filaments are not parted or damaged. With blade-type cutters, this looping angle is preferably more than 90° which permits the tension in the yarn which is required to maintain the yarn in contact with the guide surface to be maintained relatively low.

In accordance with the method of this invention, the "spun-look" character being imparted to the yarn may be enhanced by processing multifilament yarns whereby certain filaments making up a portion of the yarn have different properties with regard to elongation and strength from other filaments in the yarn. Thus, the amount of loops, bows, coils and the like may be increased, and thereby the amount of free filament ends projecting from the yarn may be similarly increased, where particular filaments having different properties are employed. One particular advantage of using such blended filament yarns also resides in the fact that one particular filament component of the yarn may be selected for imparting strength properties to the yarn while another filament component may be selected to provide the "spun-look" character to the yarn. Preferably, filaments of different polymers, such as polyamides and polyester, are used in such blended filament yarns. However, it is also contemplated by the present invention that filaments of the same polymer but having different size or denier may be employed.

In any event, it is particularly contemplated by this invention that the yarn leaving the air texturing zone has a significant number of filaments which have substantially retained their in-line or straight condition and, thus, will determine the strength characteristics of the yarn whereas other filaments are deflected from their in-line or straight condition and have loops, bows, coils and the like formed therein which project from the surface of the yarn. The development of the loops, bows, coils and the like are influenced by the technological parameters of the texturing zone and also by the particular character of the yarns utilized in carrying out the present method. by utilizing blended filament yarns as discussed above, these desirable characteristics can be particularly controlled and the resulting yarn can be provided with particular features of appearance, bulk and hand.

In the drawings and specification there have been illustrated and described several embodiments of the present invention, and although specific terms are employed, they are used in a generic and descriptive sense only and not for purposes of limitation.

What is claimed is:

1. A method of producing a synthetic multifilament yarn having appearance, bulk and hand characteristics of conventional spun yarns of staple fibers while retaining strength characteristics of continuous filament yarns, said method comprising the steps of:

feeding the continuous multifilament yarn through a high velocity air jet texturing device while forming loops, bows, coils and the like in the filaments defining the surface of the yarn, feeding the textured yarn from the air jet texturing device through a false twist device while false twisting the yarn, and parting at least some of the filaments having loops, bows, coils and the like therein by contacting such filaments with a filament parting device while guiding said yarn past the filament parting device along a predetermined path of travel which limits contact between the filament parting device and the yarn solely to the surface filaments to maintain the interior filaments of the yarn substantially intact to form free filament or fiber ends projecting from a strong substantially uninterrupted filament core.

2. A method according to claim 1 wherein the step of parting at least some of the surface filaments occurs while the yarn has twist therein.

3. A method according to claim 1 wherein the step of false twisting occurs with the yarn substantially at room temperature.

4. A method according to any one of claims 1–3 wherein the yarn comprises a blend of filaments having different elongation and strength characteristics to thereby react differently to the steps of air jet texturing and false twisting.

5. A method according to claim 4 wherein said filaments are of different polymers.

6. A method according to claim 4 wherein said filaments are of different size or denier.

7. A method of producing a synthetic multifilament yarn having appearance, bulk and hand characteristics of conventional spun yarns of staple fibers while retaining strength characteristics of a continuous filament yarn, said method comprising the steps of:

feeding the continuous multifilament yarn through a high velocity air jet texturing device while forming loops, bows, coils and the like in the filaments defining the surface of the yarn, stabilizing the textured yarn by tensioning the yarn to provide relatively straight continuous filaments forming the core of the yarn and filaments with loops, bows, coils and the like therein forming the surface of the yarn, and parting only the surface filaments at the loops, bows, coils and the like therein by contacting such filaments with a filament parting device while guiding said yarn past the filament parting device along a predetermined path of travel which limits contact between the filament parting device and the yarn only to the surface filaments to maintain the interior or core filaments of the yarn substantially intact to form free filament or fiber ends projecting from the strong, substantially uninterrupted filament core.

8. A method according to claim 7 wherein the step of parting the surface filaments includes cutting or breaking the loops, bows, coils and the like projecting from the surface of the yarn while shielding the core filaments from such cutting or breaking action.

9. A method according to claim 8 wherein the step of stabilizing the textured yarn includes false twisting the textured yarn while under tension.

10. A method according to claim 9 wherein the steps of air texturing and false twisting the yarn are separated by passing the textured yarn through a twist stop device to prevent the false twist from entering the air texturing zone, and wherein the step of parting the surface filaments of the yarn occurs between the twist stop device and the point at which false twist is applied to the yarn.

11. A method according to any of claims 8–10 wherein the step of parting the surface filaments comprises cutting the loops, bows, coils and the like therein by a cutting device, and wherein the step of shielding the core filaments comprises passing the yarn over a guide surface spaced from the cutting device a sufficient distance so that only the loops, bows, coils and like in the surface filaments are presented to the cutting device.

12. A method according to any of claims 8–10 wherein the step of parting the surface filaments comprises breaking the loops, bows, coils and the like therein by a moving friction surface.

13. A method of producing a synthetic multifilament yarn having appearance, bulk and hand characteristics of conventional spun yarns of staple fibers while retaining strength characteristics of a continuous filament yarn, said method comprising the steps of:

feeding the continuous multifilament yarn through a texturing zone and through a high velocity air jet texturing device located in the texturing zone while forming loops, bows, coils and the like in the filaments defining the surface of the yarn, feeding the textured yarn from the texturing zone through a stabilizing zone while stabilizing the yarn by tensioning the same to provide relatively straight continuous filaments forming the core of the yarn and filaments with loops, bows, coils and the like therein forming the surface of the yarn and by false twisting the yarn and while limiting the twist in the yarn to the stabilizing zone, and parting only the surface filaments at the loops, bows, coils and the like therein by contacting such filaments with a filament parting device while guiding said yarn past the filament parting device along a predetermined path of travel which limits contact between the filament parting device and the yarn only to the surface filaments to maintain the interior or core filaments of the yarn substantially intact to form free filament or fiber ends projecting from the substantially continuous filament core .

14. A method according to claim 13 wherein the step of false twisting comprises passing the yarn through a false twist spindle and wherein the step of parting the surface filaments comprises cutting the loops, bows, coils and the like by a cutting device while passing the twisted yarn over a guide surface spaced from the cutting device a sufficient distance so that only the loops, bows, coils and the like in the surface filaments are presented to the cutting device and the core filaments are shielded therefrom.

15. A method according to claim 13 wherein the step of false twisting comprises contacting the yarn being fed through the stabilizing zone with a friction false twist device, and wherein the step of parting the surface filaments comprises rupturing the loops, bows, coils and the like in the surface filaments of the yarn by a moving friction surface.

16. A method according to claim 15 wherein the false twist is imparted to the yarn by a cup-shaped false twist friction element into contact with which the yarn is guided and wherein contact with the moving filament parting friction surface is limited by recessing such friction surface a sufficiently small distance away from the path of travel of the yarn adjacent the areas of contact with the false twist friction element so that only the outwardly projecting loops, bows, coils and the like of the surface filaments contact the filament parting surface.

17. A method according to claim 15 wherein the false twist is imparted to the yarn by at least one rotating false twist friction disc into contact with which the yarn is guided, and wherein contact with the filament parting friction surface is limited by such friction surface being defined by the periphery of at least one friction disc disposed with respect to the path of travel of the yarn into contact with the false twist friction disc so that the periphery of said filament parting disc contacts only the surface filaments of the yarn.

18. A method according to claim 17 wherein the step of false twisting the yarn is accomplished by contacting the yarn by a false twist friction assembly defined by a plurality of false twist friction discs arranged in a predetermined pattern around the path of travel of the yarn.

19. A method according to claim 18 wherein the step of rupturing the surface filaments is accomplished by contacting the yarn by the peripheries of two filament parting friction discs disposed on opposite sides of each false twist friction disc with such filament parting discs being of sufficiently smaller diameter than the false twist friction discs.

20. A method according to any of claims 13–19 wherein the step of false twisting the yarns occurs with the yarn at a temperature substantially below the thermal setting temperature of the filaments of the yarn.

21. A method according to claim 20 including heating the yarn to a temperature above the thermal setting temperature of the filaments of the yarn after it has passed through the stabilizing zone to set the remaining texture imparted to the yarn by the air jet texturing device.

22. A method according to claim 21 wherein the yarn comprises a blend of filaments having different elongation and strength characteristics to thereby react differently to the steps of air jet texturing and false twisting.

23. A method according to claim 22 wherein said filaments are of different polymers.

24. A method according to claim 22 wherein said filaments are of different sizes or denier.

25. Apparatus for producing a synthetic multifilament yarn having appearance, bulk and hand characteristics of conventional spun yarns of staple fibers while retaining strength characteristics of continuous filament yarns, said apparatus comprising high velocity air jet texturing means for forming loops, bows, coils and the like in filaments defining at least the outer surface of a multifilament yarn, means for imparting false twist to the textured yarn, means disposed between said air texturing means and said false twist means for contacting and parting at least some of the filaments having loops, bows, coils and the like therein on the surface of the yarn, and means for guiding said yarn past said filament parting means along a predetermined path of travel for limiting contact of said filament parting means to only the surface filaments of the yarn.

26. Apparatus according to claim 25 wherein said filament contacting and parting means comprises cutting means movable transversely of the path of travel of the yarn and further wherein said contact limiting means comprises guide means for guiding the yarn past said cutting means in a path of travel where only the surface filaments can contact said cutting means.

27. Apparatus according to claim 25 wherein said filament contacting and parting means comprises abrasive means having a friction surface movable transversely of the path of travel of the yarn, and further wherein said contact limiting means comprises means mounting said abrasive means in predetermined relation to the path of travel of the yarn from said air texturing means to said false twist means so that said friction surface contacts only the surface filaments of the yarn.

28. Apparatus according to claim 25 wherein said false twist means comprises a rotatable false twist spindle through which the yarn passes, a false twist pin mounted in said spindle and adapted to have the yarn looped or wrapped therearound, and spindle drive means for rotating said spindle at the desired speed, and wherein said filament contacting and parting means comprises a movable cutter adapted to contact and sever the projecting loops, bows, coils and the like of the surface filaments of the yarn.

29. Apparatus according to claim 28 wherein said cutter comprises a reciprocating cutter cooperating with a stationary surface positioned along the path of travel of the yarn to the false twist means for shearing the projecting loops, bows, coils and the like of the surface filaments of the yarn.

30. Apparatus according to claim 28 wherein said cutter comprises a rotatable cutter having a plurality of blades carried around the outer periphery thereof for contact with the surface filaments of the yarn as it passes by said rotating cutter.

31. Apparatus according to claim 25 wherein said false twist means comprises friction false twist means including at least one friction surface moving transversely of the path of travel of the yarn and adapted to contact the yarn to impart false twist thereto, and wherein said filament contacting and parting means comprises at least one additional friction surface moving transversely of the path of travel of the yarn and having a surface roughness greater than said friction false twist means.

32. Apparatus according to claim 31 wherein said friction false twist means comprises a rotatable cup-shaped member having an outer rim, said outer rim being defined by two spaced apart friction members extending concentrically about the outer surface of said cup-shaped member and defining a space therebetween, and guide means for guiding the yarn into contact with said rim at two locations along the path of the yarn and at two, substantially diametrically opposed, areas of said rim, and wherein said filament contacting and parting means comprises another friction member extending around the rim of said cup-shaped member between said two false twist imparting friction members.

33. Apparatus according to claim 32 wherein said contact limiting means comprises means mounting said filament parting friction member in recessed relation to the outer surface of said false twist imparting friction members so that only the projecting loops, bows, coils and the like of the surface filaments of the yarn will contact said filament parting friction surface and be ruptured or parted thereby.

34. Apparatus according to claim 25 wherein said false twist means comprises at least one rotatable disc having an at least partially curved yarn contacting friction surface and guide means for guiding the yarn in contact with said friction surface along a predetermined path of travel, at least a portion of which substantially conforms to the curvature of the friction surface of said rotatable disc, and wherein said filament contacting and parting means comprises another rotatable friction disc having a friction surface of greater roughness than the false twist imparting friction disc and mounted adjacent the path of travel of said yarn adjacent the portion of that path of travel wherein the yarn has twist therein for contacting and rupturing or parting the projecting loops, bows, coils and the like in the surface filaments of the yarn.

35. Apparatus according to claim 34 wherein said false twist imparting disc and said filament parting disc are mounted for rotation concentrically about the same axis of rotation.

36. Apparatus according to claim 35 wherein filament parting disc is mounted adjacent the false twist imparting disc and has its roughened surface positioned on the side thereof facing the false twist imparting disc and spaced from the surface of the false twist imparting disc a predetermined distance so as to contact and part the projecting loops, bows, coils and the like of the first surface filaments of the yarn as the yarn passes over the surface of the false twist imparting disc.

* * * * *